US007106157B2

(12) United States Patent
Sung et al.

(10) Patent No.: US 7,106,157 B2
(45) Date of Patent: Sep. 12, 2006

(54) SOLENOID SWITCH AND PLATING METHOD THEREOF

(75) Inventors: Bu-hyun Sung, Suwon-si (KR); Soon-kyo Hong, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 130 days.

(21) Appl. No.: 10/736,842

(22) Filed: Dec. 17, 2003

(65) Prior Publication Data

US 2004/0140192 A1 Jul. 22, 2004

(30) Foreign Application Priority Data

Jan. 17, 2003 (KR) ..... 10-2003-0003254

(51) Int. Cl.
*H01F 7/08* (2006.01)

(52) U.S. Cl. ..... 335/220

(58) Field of Classification Search ..... 335/220–229
See application file for complete search history.

(56) References Cited

U.S. PATENT DOCUMENTS

| | | | | |
|---|---|---|---|---|
| 3,745,386 | A * | 7/1973 | Lloyd | 310/13 |
| 4,134,090 | A * | 1/1979 | Schuessler et al. | 335/229 |
| 4,458,230 | A * | 7/1984 | Shimizu | 335/271 |
| 5,083,744 | A * | 1/1992 | Oliver et al. | 251/129.11 |
| 6,439,705 | B1 * | 8/2002 | Eida | 347/85 |

* cited by examiner

*Primary Examiner*—Elvin Enad
*Assistant Examiner*—Bernard Rojas
(74) *Attorney, Agent, or Firm*—Staas & Halsey LLP

(57) ABSTRACT

A latch type solenoid switch including a frame, a permanent magnet providing magnetic force to the frame, a coil unit which offsets the magnetic force of a permanent magnet when power is supplied, and a moving part which adheres to and detaches from the frame depending on the power supply to the coil unit. Anti-corrosion coating is applied to the surface of the frame and the moving part. The plating thickness on the contact surfaces between the frame and the moving part is thinner than on the other surfaces of the two bodies.

5 Claims, 6 Drawing Sheets

SOLENOID SWITCH AND PLATING METHOD THEREOF

CROSS-REFERENCE TO RELATED APPLICATIONS

This application claims the benefit of Korean Patent Application No. 2003-3254, filed Jan. 17, 2003, in the Korean Intellectual Property Office, the disclosure of which is incorporated herein by reference.

BACKGROUND OF THE INVENTION

1. Field of the Invention

The present invention relates to a solenoid switch, and more particularly, to a latch type solenoid switch plated with anti-corrosion material and a method of plating the solenoid switch.

2. Description of the Related Art

A solenoid switch operates by magnetic forces applied by a permanent magnet and an electromagnet. FIG. 1 illustrates the structure of a general latch type solenoid switch.

Referring to FIG. 1, the solenoid switch includes a coil unit 10, a frame 20, a permanent magnet 30 and a moving part 40. The coil unit 10 includes a coil 12 wound around a cylindrical bobbin 11, and when current is supplied to the coil unit 10, a magnetic field is generated in a direction opposite to a magnetic field of the permanent magnet 30. A section of the moving part 40 is inserted into the bobbin 11, and is elastically biased away from the permanent magnet 30 by a spring 50.

In the above structure, when current is not supplied to the coil unit 10, the moving part 40 adheres to the frame 20 due to force acting thereon in the magnetic field of the permanent magnet 30. When current is supplied to the coil unit 10, a magnetic field opposite to that of the permanent magnet 30 is generated in the coil unit 10, and the moving part 40 is detached from the frame 20 by the restoration force of the spring 50. In this way, depending on the current supply to the coil unit 10, the moving part 40 moves in the directions indicated by the arrow in FIG. 1.

In general, the frame 20 and the moving part 40 are made of steel and are plated to prevent corrosion. The layer of plating has a thickness of about 3 μm, which is very thin. If the layer of plating is too thin, chemical resistance to salt in sweat from people's hands may be too weak. In order to increase resistance against corrosion, a sufficiently thick layer of plating is necessary, but if the layer is too thick, there is a possibility of reducing the adhesion force between the moving part 40 and the frame 20 by shielding the moving part 40 from the magnetic field of the permanent magnet 30.

SUMMARY OF THE INVENTION

Accordingly, it is an aspect of the present invention to provide an improved solenoid switch and a method of plating the switch to effectively prevent corrosion of a moving part and a frame, without shielding the magnetic field of a permanent magnet.

Additional aspects and/or advantages of the invention will be set forth in part in the description which follows and, in part, will be obvious from the description, or may be learned by practice of the invention.

The foregoing and/or other aspects of the present invention may be achieved by providing a solenoid switch including a frame; a coil unit to selectively generate a magnetic field; and a moving part including a first surface selectively in contact with the frame based upon the magnetic field of the coil unit, a second surface not in contact with the frame, and an anti-corrosion material coating the first and second surfaces, a thickness of the anti-corrosion material being thinner on the first surface than on the second surface.

The foregoing and/or other aspects of the present invention may also be achieved by providing a method of plating a solenoid switch including a frame having a contact surface, and a moving part including a contact surface selectively in contact with the contact surface of the frame, the method including plating the frame and the moving part with a first anti-corrosion material having a first thickness; removing the first anti-corrosion material from the contact surfaces of the frame and the moving part; and re-plating the frame and the moving part with a second anti-corrosion material having a second thickness.

The foregoing and/or other aspects of the present invention may also be achieved by providing an apparatus to record and/or generate data to/from an optical medium, including a fixed frame; a tray; and a tray locking device, to selectively lock/unlock the tray to the fixed frame, including a locking post fixed on the fixed frame, a first lever, rotatably installed on the tray, including a locking portion selectively locked/unlocked to/from the locking post and a cam to selectively interfere with the locking post to turn the first lever in a direction which the locking portion can lock to the locking post, a first elastic member to bias the locking portion towards the locking post, a solenoid switch, provided on the tray, including a frame including a contact surface and a non-contact surface, a moving part including a contact surface to selectively contact the contact surface of the frame and a non-contact surface not in contact with the frame, a permanent magnet disposed within the frame to generate a magnetic force to attract the moving part, a coil to selectively generate a magnetic force to offset the magnetic force of the permanent magnet, and an anti-corrosion material coating the frame and the moving part, a second lever rotatably mounted to the tray and connected to the moving part and the first lever, and a second elastic member connected to the second lever to release the locking portion from the locking post when the moving part is detached from the frame, wherein a thickness of the anti-corrosion material is thinner at the contact surfaces than at the non-contact surfaces of the frame and the moving part.

BRIEF DESCRIPTION OF THE DRAWINGS

These and/or other aspects and advantages of the invention will become apparent and more readily appreciated from the following description of the embodiment, taken in conjunction with the accompanying drawings of which.

DETAILED DESCRIPTION OF THE PREFERRED EMBODIMENT

Figure 1:
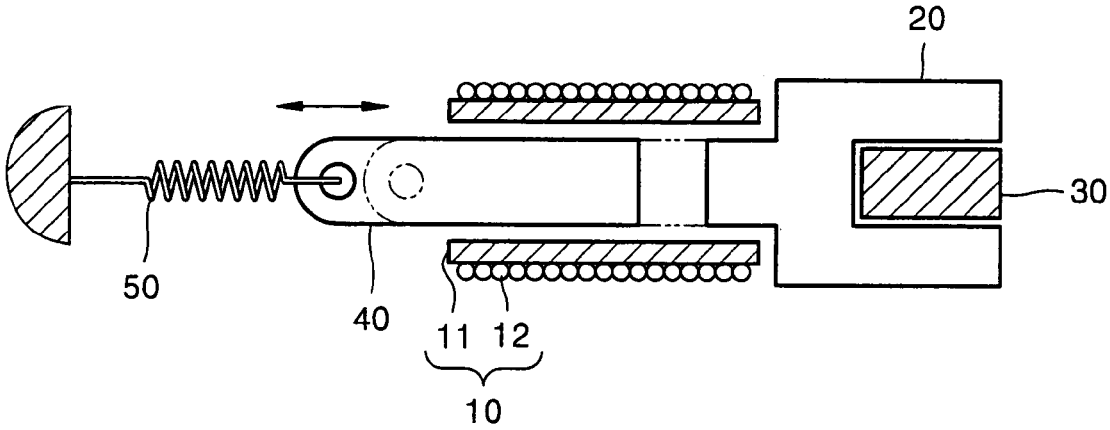
FIG. 1 (PRIOR ART)
FIG. 1 illustrates the structure of a general solenoid switch.

Reference will now be made in detail to the embodiment of the present invention, an example of which is illustrated in the accompanying drawings, wherein like reference numerals refer to the like elements throughout. The embodiment is described below to explain the present invention by referring to the figures.

Figure 2:
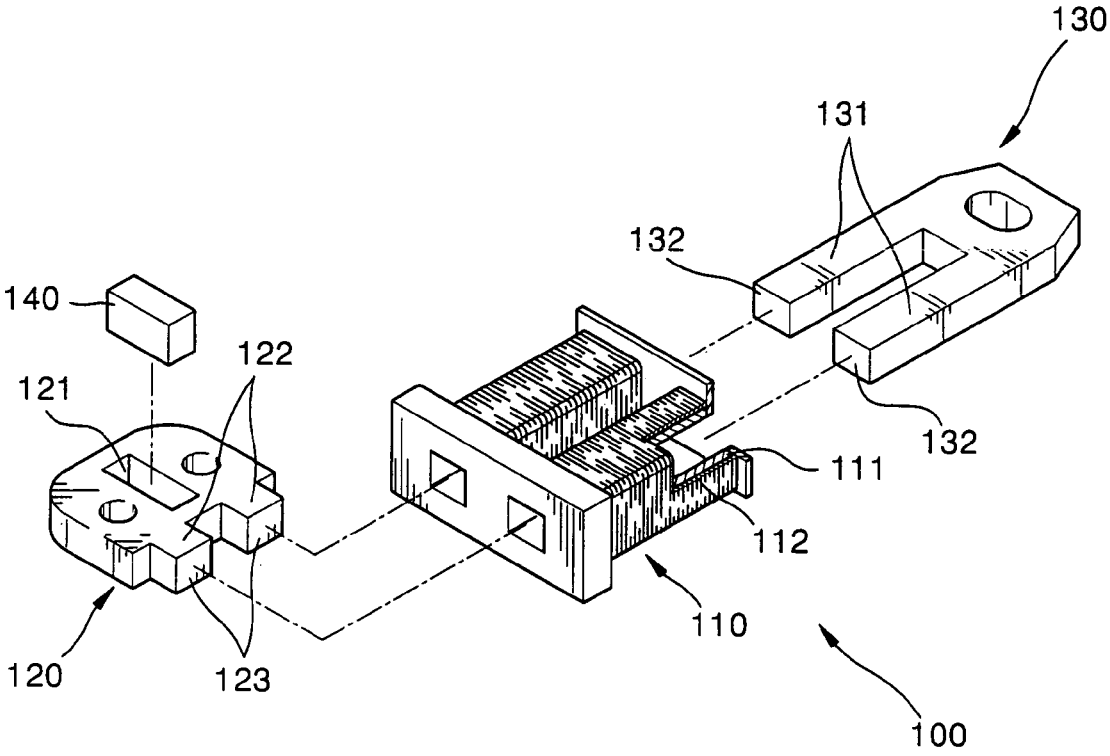
FIG. 2 is an exploded view of a solenoid switch according to an embodiment of the present invention.

FIG. 2 is an exploded perspective view of a latch type solenoid switch 100 according to an embodiment of the present invention.

Referring to FIG. 2, a frame 120 and a moving part 130 are disposed at opposite sides of a coil section 110. A permanent magnet 140 is connected to the frame 120. The coil section 110 includes a coil 112 wound around twin, hollow, rectangular tubes of a bobbin 111, and when current is supplied to the coil section 110, a magnetic field is generated in a direction opposite to the magnetic field of the permanent magnet 140. The frame 120 connected to the coil section 110 includes two parts: a first part 121 connects to the permanent magnet 140 and the second part includes projections 122 which are inserted a short distance into the hollow tubes of the bobbin 111.

The moving part 130 has two arms 131 which make contact with the projections 122 of the frame 120 due to attraction toward the permanent magnet 140 in the bobbin 111. Although not shown in the drawings, the moving part 130 is elastically biased away from the permanent magnet 140 by an elastic member such as a spring.

In the above structure, when no current is supplied to the coil section 110, the moving part 130 makes contact with the frame 120 due to the attraction of the permanent magnet 140. When current is supplied to the coil section 110, the moving part experiences a magnetic force that counteracts that of the permanent magnet 140. Then, the restoration force of the elastic member (not shown) causes the moving part 130 to detach from the frame 120.

The frame 120 and the moving part 130 are made of ordinary steel. Because steel is corroded by moisture or salt, the surface of the frame 120 and the moving part 130 are plated with anti-corrosion material to prevent corrosion. Anti-corrosion materials are nonferrous and have a diamagnetic composition such as nickel or copper and nickel.

In order to provide effective prevention against corrosion, it is necessary for the plating to have a certain thickness. For example, if nickel or copper and nickel is used as the anti-corrosion material, the required thickness of the plating is more than 7 μm. However, in this case, the force of adhesion between the moving part 130 and the frame 120 can be decreased by the anti-corrosion material.

A contact surface 132 of the moving part 130 accounts for only a very small portion of the total surface area of the moving part 130, and likewise for a contact surface 123 of the frame 120. Hence, it is unlikely for the contact surfaces 132 and 123 to be touched by hand during handling. Therefore, the contact surfaces 132 and 123 are less likely to corrode than other areas, even if the anti-corrosion plating is thinner on the contact surfaces 132 and 123.

According to these considerations, for the solenoid switch 100 according to the embodiment of the present invention, the contact surfaces 132 and 123 of the moving part 130 and frame 120 are plated thinner than the other surfaces of these elements. That is, the other surfaces except for the contact surfaces 132 and 123 are plated with a thickness of at least 7 μm in order to prevent corrosion, and the contact surfaces 132 and 123 are plated with anti-corrosion material to a thickness of about 3 μm to minimize reduction of the force of adhesion.

The following is a detailed description of a method of plating of a solenoid switch according to the embodiment of the present invention.

Figure 3:
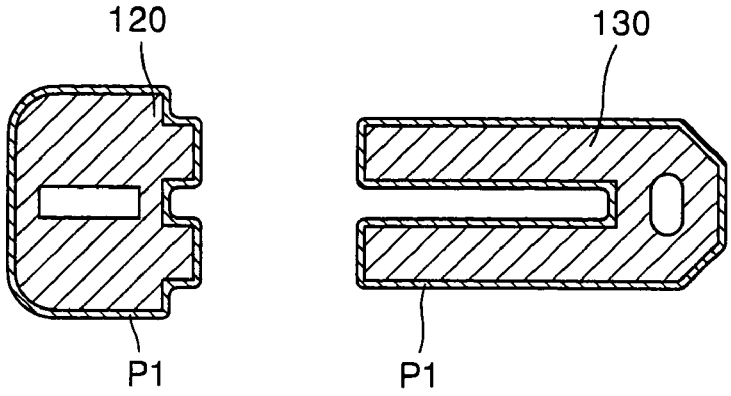
FIGS. 3 through 5 illustrate operations of a method of plating the solenoid switch of FIG. 2, according to the embodiment of the present invention.

First, as illustrated in FIG. 3, a uniform plating layer P1 is formed on the surface of the moving part 130 and the frame 120 with anti-corrosion material which may be nickel or copper and nickel. The thickness of the layer P1 is about 5~9 μm (the first thickness).

Figure 4:
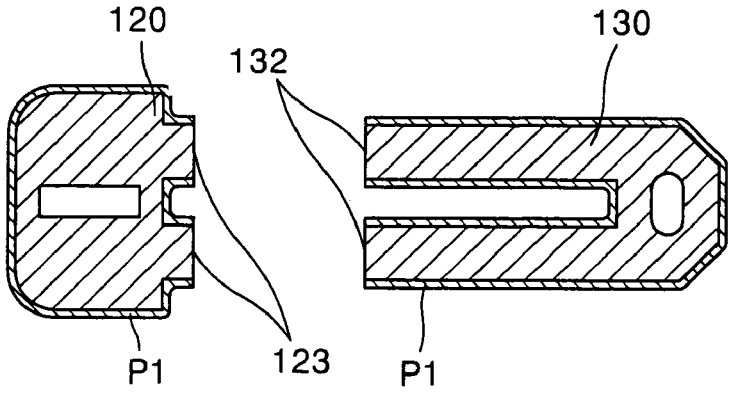

Second, the plating layer P1 on the contact surfaces 132 and 123 is removed either by grinding or by chemical means, so that all surfaces, except the contact surfaces 132 and 123, are covered with a plating layer P1 of about 5~9 μm thickness (FIG. 4). In FIG. 4, the steel is exposed where needed at the contact surfaces 132 and 123.

Figure 5:
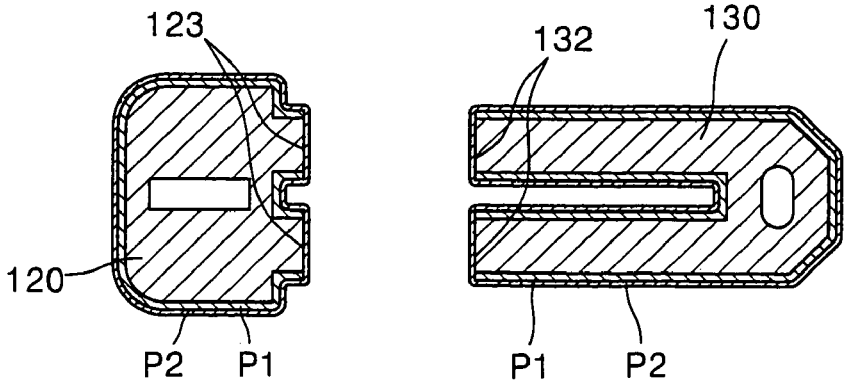

Next, the plated surfaces of the moving part 130 and the frame 120 are re-plated with anti-corrosion material which is nickel or copper and nickel, and this forms a second plating layer P2. The thickness of the second plating layer P2 is about 3 μm. Then, as illustrated in FIG. 5, the thickness of the plating is about 8~12 μm on all surfaces except for the contact surfaces 132 and 123, and is about 3 μm on the contact surfaces 132 and 123.

In the plating method of the present embodiment, the plating layer P2 formed on the contact surfaces 132 and 123 is thin, so as to minimize the effect on the magnetic force of the permanent magnet 140. However, the plating layer formed on the rest of the moving part 130 and the frame 120 P1 and P2 is of a reasonable thickness for the purpose of effectively preventing corrosion.

Figure 6:
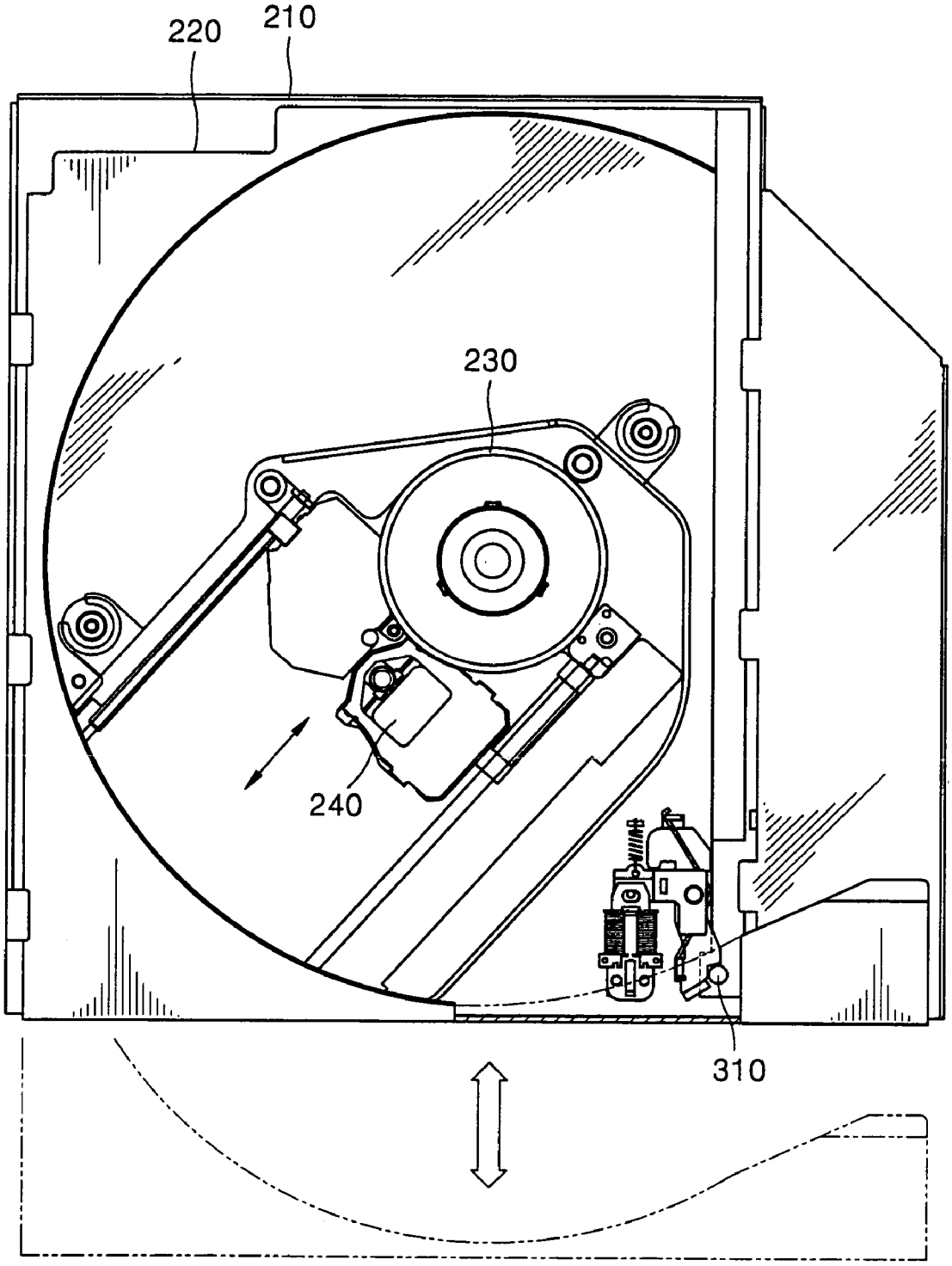
FIGS. 6 and 7 illustrate an application of the solenoid switch of the embodiment of the present invention to a tray locking device of a slim optical disc drive.
Figure 7:
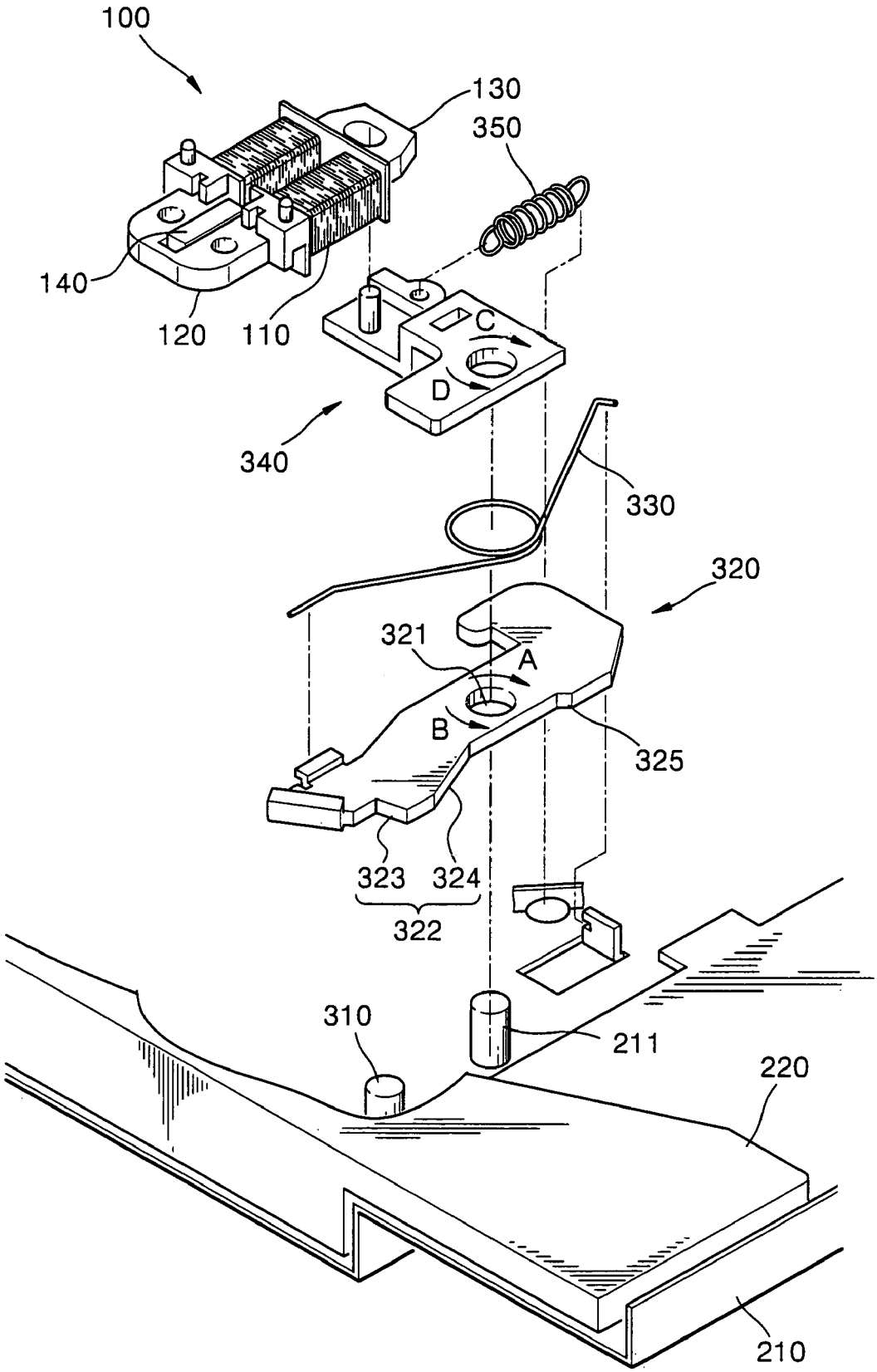
Figure 8:
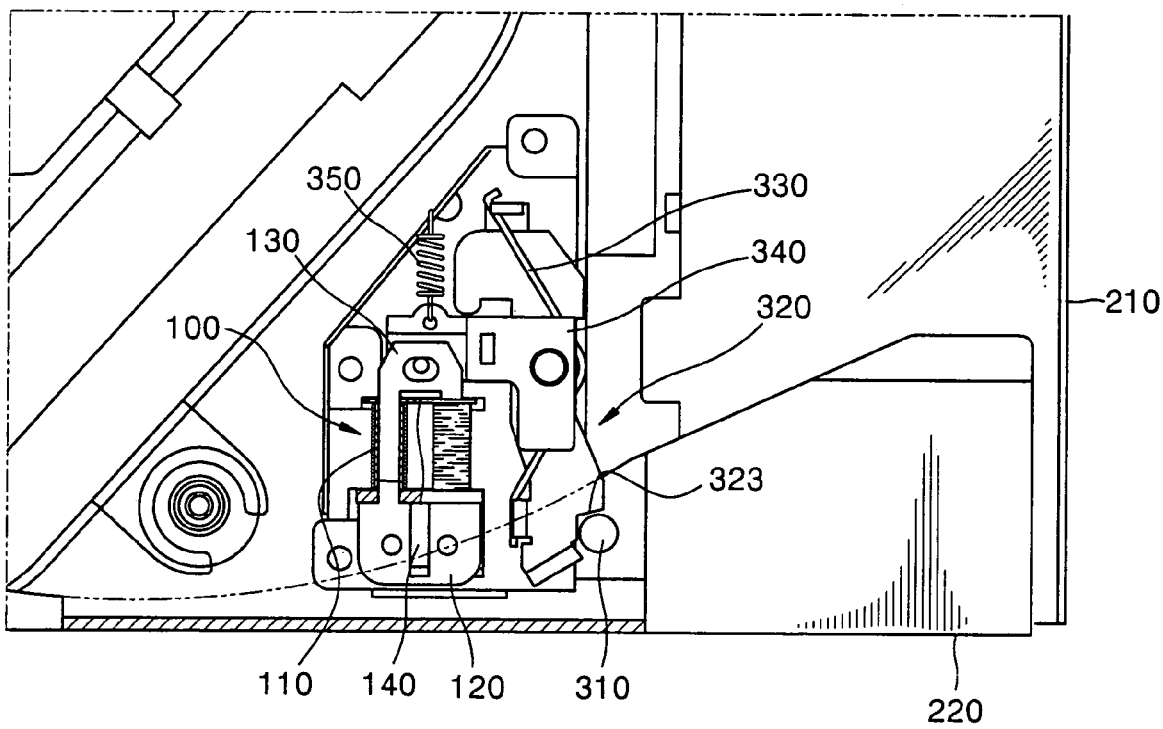
FIGS. 8 and 9 respectively illustrate locked and unlocked states of the tray shown in FIG. 6 and FIG. 7.
Figure 9:
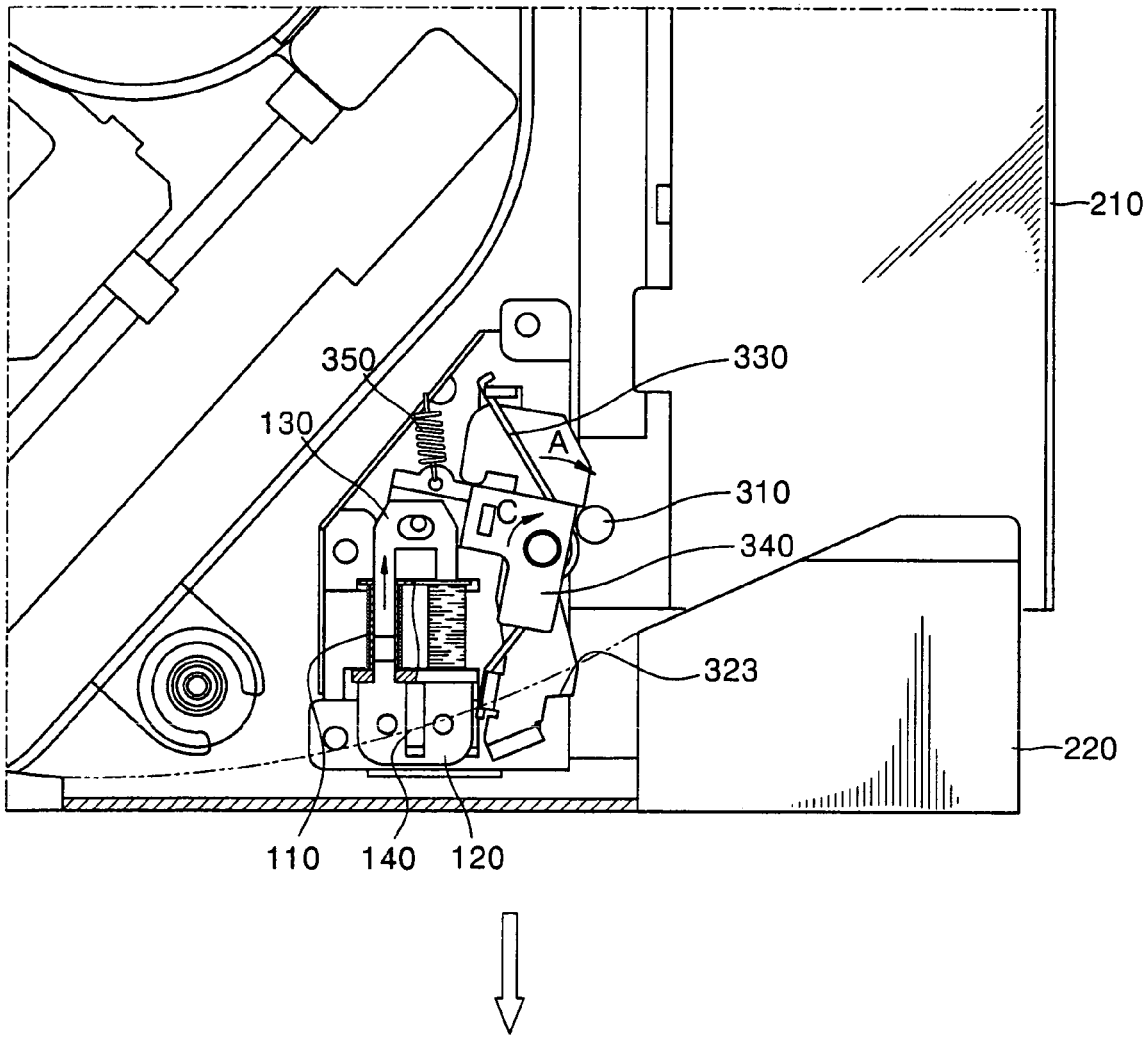

This solenoid switch technology can be applied in various fields of industry. FIG. 6 shows an example of the application of the solenoid switch 100 to a tray locking device of a slim optical disc drive. FIG. 7 is an enlarged view of the tray locking device shown in FIG. 6. FIGS. 8 and 9 illustrate locking and unlocking of a tray 220.

Referring to FIGS. 6 and 7, the tray 220 is mounted on a fixed frame 210, allowing the tray 220 to slide in and out. The tray includes a spindle motor 230 to turn a disc (not shown) and an optical pickup unit 240 which records and generates data on the disc as it slides over the surface of the disc in the directions indicated by arrows.

A locking post 310 is installed on the fixed frame 210. A first lever 320, a first elastic body 330, a second lever 340, a second elastic body 350 and the solenoid switch 100 are mounted on the tray 220.

The first lever 320 rotates in both directions about a hinge unit 321 which is mounted on a hinge post 211 of the tray 220. A working end of the first lever 320 includes a locking portion 322 which locks the tray 220 in connection with the locking post 310 when the tray 220 is loaded, while the other end of the first lever 320 includes a cam portion 325 which interferes with the locking post 310 when the tray 220 is unloaded. The locking portion 322 includes a stopper 323 to catch the locking post 310, and a slanted protrusion 324 which turns the first lever 320 in the direction indicated by A in FIG. 7, interfering with the locking post 310 when the tray 220 is loaded. The cam portion 325 turns the first lever 320 in the direction indicated by B in FIG. 7, interfering with the locking post 310 when the locking post 310 and the locking portion 322 are uncoupled and when the tray 220 is unloaded.

The first elastic body 330 provides an elastic force for the first lever 320 to enable docking between the locking post 310 and the stopper 323, that is, to make the first lever 320 turn in the direction indicated by B in FIG. 7.

The second lever 340 is rotatably mounted on the tray 220 and connected to the moving part 130 and the second elastic body 350.

The second lever 340 turns in the directions indicated by C and D in FIG. 7, interfering bilaterally with the first lever 320. That is, the second lever 340 turns in the direction C by the elastic force of the second elastic body 350, pushing the first lever 320 so that it turns in the direction indicated by A. However, when the first lever 320 turns in the direction indicated by B, it pushes the second lever 340 to turn in the direction indicated by D.

The second elastic body 350 provides an elastic force to the second lever 340 to turn it in the direction indicated by C. The magnitude of the elastic force provided by the second elastic body 350 to the 2nd lever 340 is large enough to overcome the elastic force of the first elastic body 330 and turn the first lever 320 in direction A.

In this model, the moving part 130 is in contact with the frame 120 while the tray 220 is loaded and locked to the fixed frame 210, as indicated in FIG. 8. When current is supplied to the coil section 110, the magnetic field of the permanent magnet 140 is offset by the magnetic field generated in the coil section 110. Then, the elastic force of the second elastic body 350 turns the second lever 340 in direction C, detaching the moving part 130 from the frame 120, as indicated in FIG. 9. The second lever 340 turns the first lever 320 in direction A, so that the stopper 323 is released from the locking post 310. The tray 220 is now no longer locked. In this state, the tray 220 is unloaded.

In order to maintain the tray 220 in a locked state on the fixed frame 210, the force of adhesion between the moving part 130 and the frame 120 is stronger than the elastic force of the second elastic body 350. As explained earlier, if the thickness of the anti-corrosion plating on the surface of the moving part 130 and on the frame 120 exceeds, for example, 7 μm, the magnetic field of the permanent magnet 140 could be blocked, thus weakening the force of adhesion between the moving part 130 and the frame 120.

In this case, one method to be considered is to employ a larger permanent magnet 140 to overcome the elastic force of the second elastic body 350. However, the space available for the solenoid switch 100 is very limited in the slim-type optical drive, since it is designed for compact mobile computers. Therefore, the adoption of a larger permanent magnet 140 is not appropriate in this case.

Another option is to reduce the elastic force of the second elastic body 350. In this case, the locking force between the stopper 323 and the locking post 310 is weakened because it is necessary to reduce the elastic force of the first elastic body at the same time. As a result, the tray can be unlocked too easily, such as by a light impact.

However, the problems described above can be solved by adopting the solenoid switch 100 of the embodiment of the present invention. The solution is for the thickness of anti-corrosion material plated on the contact surfaces 123 and 132 of the moving part 130 and the frame 120 to be, for example, as thin as about 3 μm, to minimize weakening adhesion, while the thickness of plating on other areas is about 7 μm, for example.

By adopting the solenoid switch and the plating method described above, it is possible to prevent both corrosion and weakening of adhesion by plating the contact surfaces 123 and 132 more thinly than other surfaces.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A solenoid switch comprising:

a frame;

a coil unit to selectively generate a magnetic field; and a moving part comprising:

a first surface selectively in contact with the frame based upon the magnetic field of the coil unit, a second surface not in contact with the frame, and an anti-corrosion material coating the first and second surfaces, a thickness of the anti-corrosion material being thinner on the first surface than on the second surface.

2. The solenoid switch of claim 1, wherein the frame comprises:

a first surface selectively in contact with the first surface of the moving part based upon the magnetic field of the coil unit;

a second surface not in contact with the moving part; and an anti-corrosion material coating the first and second surfaces of the frame, wherein a thickness of the anti-corrosion material of the frame is thinner on the first surface of the frame than on the second surface of the frame.

3. The solenoid switch of claim 1, further comprising:

a permanent magnet to generate a magnetic field to attract the moving part to the frame, wherein the magnetic field of the coil unit offsets the magnetic field of the permanent magnet.

4. The solenoid switch of claim 2, wherein the thickness of the anti-corrosion material on the first surfaces of the moving part and the frame is about 3 μm.

5. The solenoid switch of claim 3, wherein the thickness of the anti-corrosion material on the second surfaces of the moving part and the frame is at least 7 μm.

* * * * *